US008196877B2

(12) United States Patent
Gridley et al.

(10) Patent No.: US 8,196,877 B2
(45) Date of Patent: Jun. 12, 2012

(54) FLEXPOLE SUPPORT APPARATUS

(76) Inventors: William Gridley, Dousman, WI (US); Randall B. Scott, Helenville, WI (US)

( * ) Notice: Subject to any disclaimer, the term of this patent is extended or adjusted under 35 U.S.C. 154(b) by 378 days.

(21) Appl. No.: 12/464,045

(22) Filed: May 11, 2009

(65) Prior Publication Data

US 2009/0278016 A1 Nov. 12, 2009

Related U.S. Application Data

(60) Provisional application No. 61/052,415, filed on May 12, 2008.

(51) Int. Cl.
*F16M 13/00* (2006.01)

(52) U.S. Cl. ..... 248/160; 248/354.1; 248/516; 52/116

(58) Field of Classification Search ..... 248/160, 248/126.1, 354.1, 354.6, 288.31, 125.7, 125.8, 248/407, 408, 410, 423, 418, 516; 52/116, 52/117, 118

See application file for complete search history.

(56) References Cited

U.S. PATENT DOCUMENTS 4,576,354 A * 3/1986 Blessing, Sr. ..... 248/354.5
4,741,505 A 5/1988 Anderson
5,056,753 A * 10/1991 Lunau et al. ..... 248/542
5,564,867 A * 10/1996 Domanski et al. ..... 405/290
5,924,469 A * 7/1999 Whittemore ..... 160/368.1
6,366,313 B1 4/2002 Hall
6,405,679 B1 6/2002 Sonnek
6,508,448 B1 1/2003 Stewart
6,511,275 B2 1/2003 Ray
7,481,404 B2 * 1/2009 Carnevali ..... 248/160
7,534,136 B2 * 5/2009 Bova ..... 439/537
7,708,508 B2 * 5/2010 Bullock ..... 410/123
7,810,771 B1 * 10/2010 Akers et al. ..... 248/200.1

* cited by examiner

*Primary Examiner* — Terrell McKinnon
*Assistant Examiner* — Steven Marsh
(74) *Attorney, Agent, or Firm* — Monty Simmons; Simmons Patents

(57) ABSTRACT

Disclosed is an improved apparatus for holding a construction item in a desired position while the construction item is being secured to a support structure. Embodiments of the apparatus comprise a pressure-plate configured with a pole-ball-socket, a pole-ball, and a flexible pole section. A plurality of pole sections may be used in a telescoping arrangement so that the apparatus may be used to lift a construction item to an elevated position. The pressure-plate defines a pressure-plate-surface configured for being associated with a surface of a construction item. The flexible pole section is then extended to move the construction item to a desired location (such as at ceiling height). Typically the pole section is held at an angle relative to a supporting surface (such as a floor) and then extended to a length about four inches longer than the distance from the supporting surface and said desired location. A side pressure is then applied to the pole section causing the pole section to flex and slide into position to support the construction item.

6 Claims, 9 Drawing Sheets

FLEXPOLE SUPPORT APPARATUS

CLAIM TO PRIORITY

This application claims priority to provisional application 61/052,415 filed on May 12, 2008, the entire contents of which are incorporated herein by this reference for all that it discloses.

FIELD OF THE INVENTION

Embodiments of the present invention relate in general to the field of construction and are particularly useful as an installation aid for installing boards such as drywall and sheetrock.

BACKGROUND OF THE INVENTION

Many construction jobs require the use of support structures. One such example relates to the installation of various boards such as drywall, sheetrock, plywood, plasterboard, soffit plywood, durock, blueboard, densglass gold, and exterior drywall, particularly at ceiling levels. Do-it-yourselfers and even professionals have been known to attempt to hold drywall up to a ceiling using their heads before securing such boards to a support structure. Such a system works, but it does require some coordination and is an awkward, unprofessional system. Indeed, getting such boards up to ceiling heights can be a particularly difficult task without the right tools.

The use of drywall support devices are known in the art. One such device is a drywall lift. A user loads a sheet of drywall on the drywall lift and then cranks it up to the ceiling. Such devices work well but are often too expensive to purchase for a do-it-yourselfer performing a one-time installation. In addition, even for professionals such drywall lifts can be inconvenient as they take up a lot of room on/in the installer's vehicle/storage area and the time of use per board is greater than is necessary.

Another drywall support apparatus is disclosed in U.S. Pat. No. 6,508,448, issued to Stewart (incorporated by this reference for all purposes). Stewart discloses an adjustable drywall support apparatus for holding a wallboard in place as it is being installed at ceiling level. The Stewart device works well for its intended purpose but such a device is more bulky and complicated to use than it need be, in part due to the ridged design of the support shaft structure.

Interestingly, installers often create their own "Stewart" type devices, called dry-wall jacks, designed specifically for a particular installation site. Such home-made devices are ridged devices typically constructed from wood with the overall height of the jack an inch taller than the height from the floor to the ceiling. Such devices waste material as the jacks are used for that one installation task and then discarded.

The above devices work well for their designed purposes but they do have their design shortcomings. One problem with such prior art devices relates, ironically, to the ridged nature of their construction. Such devices typically use an adjustable structure, such as a telescoping pole, that provides a ridged, straight support system from floor to ceiling. Such devices work well but they are more complicated to use and require more time to use (adjust) per item than is necessary.

What is needed is an improved apparatus that provides for a small, lightweight structure that is easy to store and move that provides a flexible support system that is easy and quick to adjust and use.

SUMMARY OF THE INVENTION

Some of the objects and advantages of the invention will now be set forth in the following description, while other objects and advantages of the invention may be obvious from the description, or may be learned through practice of the invention.

Broadly speaking, a principle object of the present invention is to provide an improved apparatus for holding a construction item in a desired position, such apparatus comprising a pressure-plate configured with a pole-ball-socket, a pole-ball-receiver, and a flexible pole section.

Another objective is to provide the above device configured with a plurality of pole sections configured with a latching-device wherein at least one pole section is flexible. The plurality of pole sections are movably associated with each other when the latching-device is not engaged. The plurality of pole sections are secured in place by engaging said latching-device.

For one embodiment of the invention, a pressure-plate-surface of the pressure-plate is configured for being associated with a first-item-surface of the construction-item (such as one side of a board). A second-item-surface (e.g. the opposing surface of such board) is configured for being associated with a first-construction-surface (such as a ceiling). The pressure-plate either comprises an integral pole-ball-socket or is mechanically associated with a pole-ball-socket. Such pole-ball-socket is configured to receive one end of a flexible pole section. The opposing end of such flexible pole section is preferably associated with an end cap suitably configured for being associated with a second-construction-surface (e.g. a floor) in a slip resistant manner. The flexible pole section is configured to be a predefined length. When a plurality of pole sections and latching-device(s) are used, the pole sections are adjusted to the predefined length and then secured by the latching-device.

Typically, the predefined length is about four inches longer than the distance from the first-construction-surface and the second-construction-surface.

At least part of the pole section is made of a strong but flexible material that allows the poles to flex. It should be appreciated that the above described pole-ball-socket/flexible pole configuration allows the pressure-plate-surface to move relative to the pole section so that the pressure-plate-surface maintains a desired orientation relative to the construction-item surface.

For example, suppose the construction-item is a board, and the pressure-plate-surface is a flat surface. As the pole sections flex, the pole-ball-socket moves relative to the pressure-plate-surface so that pole sections extend from the pressure-plate at an angle while the pressure-plate-surface stays flat against the board's surface. Thus, the pole section may extend perpendicularly from the pressure-plate-surface or at an angle from the pressure-plate-surface as desired by the user.

Additional objects and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
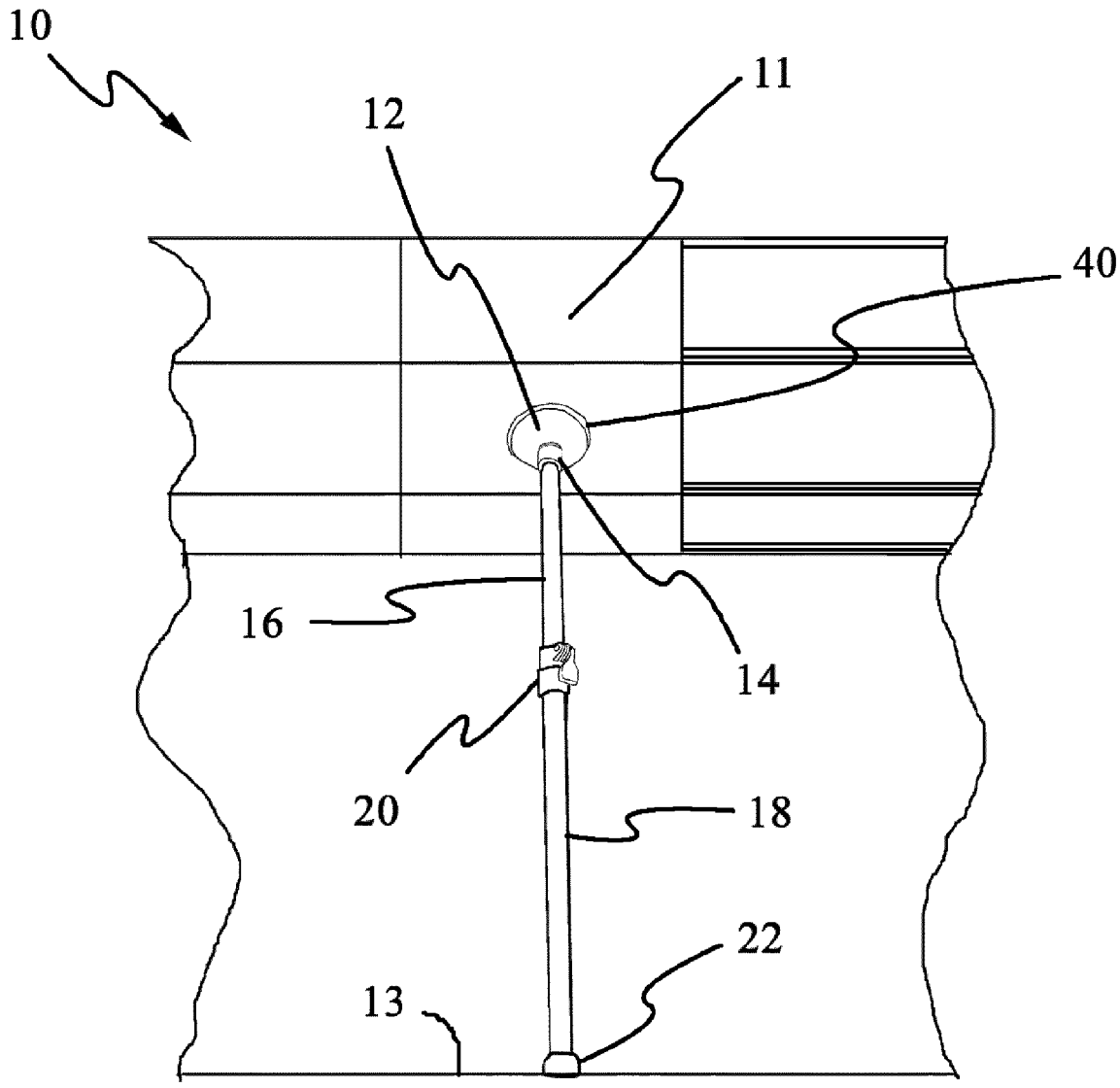
FIG. 1 is a side perspective view of one exemplary embodiment of the invention shown supporting a construction-item at ceiling level.

Repeat use of reference characters throughout the present specification and appended drawings is intended to represent the same or analogous features or elements of the present technology. Various objects, advantages, and features of the invention will become apparent to those skilled in the art from the following discussion taken in conjunction with the drawings.

DESCRIPTION OF THE PREFERRED EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

While this document contains headers, such headers are place markers only such headers are not to be used in the construction of the meaning of this document in any manner.

For the purposes of this document two or more items are "mechanically associated" by bringing them together or into relationship with each other in any number of ways including a direct or indirect physical connection that may be releasable (snaps, rivets, screws, bolts, etc.) and/or movable (rotating, pivoting, oscillating, etc.)

While the present invention may be used to apply a pressure to the surface of various types of construction items, the examples herein are directed to applying a supporting pressure to the surface of a board to be mechanically associated with a ceiling.

Figure 1B:
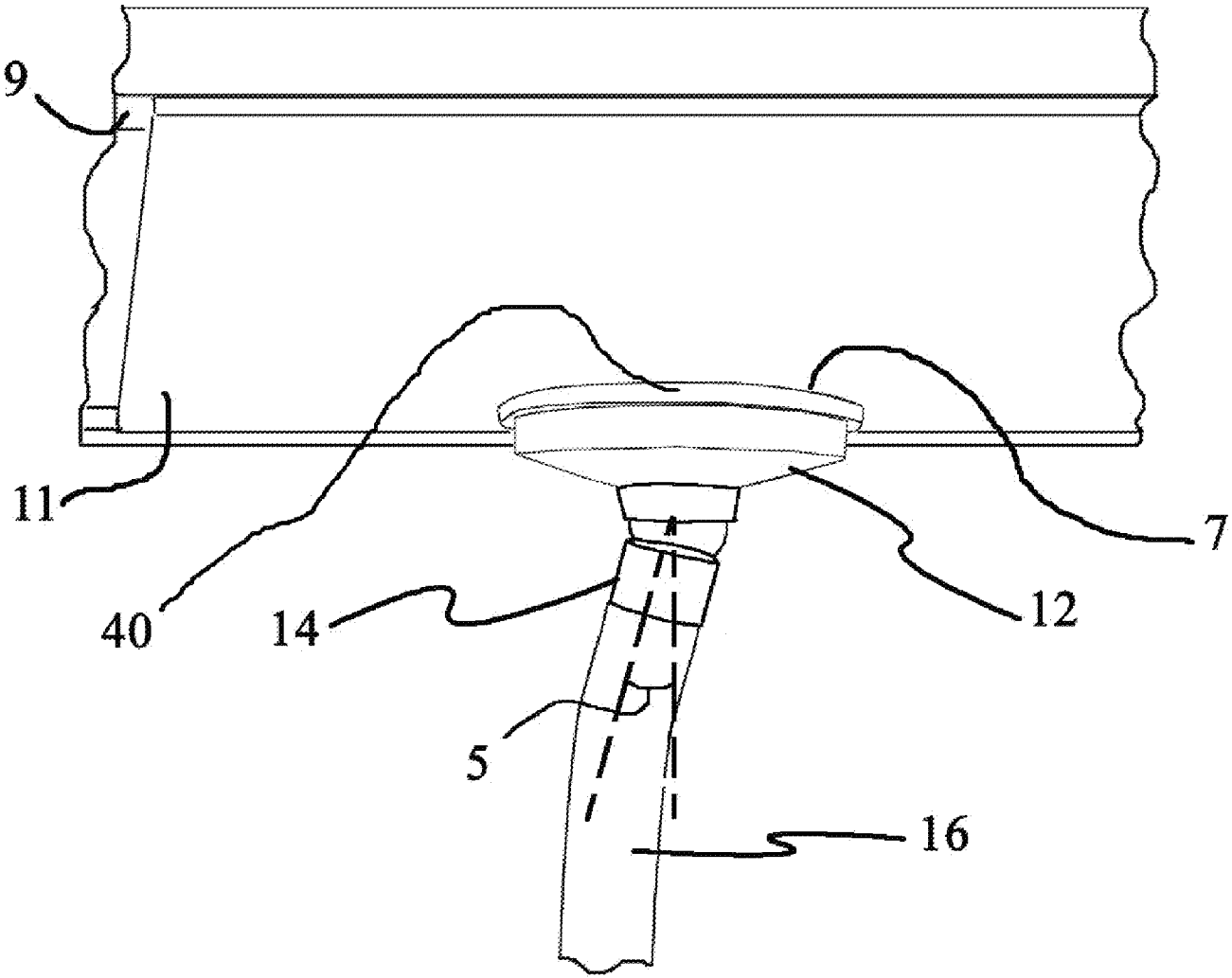
FIG. 1*b* is a close up side perspective view of the apparatus in FIG. 1.

Referring now to FIG. 1 and FIG. 1*b*, one exemplary embodiment of the invention applying a supporting pressure to one surface of a construction item (11) at the approximate height of a ceiling is presented. The apparatus comprises a pressure-plate (12) defining pressure-plate-surface (7) configured with a protective-padding (40). The pressure-plate-surface (7) and protective-padding (40) are applying a supporting pressure to a first-item-surface of construction item (11). The opposing surface of construction item (11) is configured for interfacing with a first-construction-site-surface (9) (such as a two-by-four or other support structure). Flexible pole sections (16) and (18) extend from pressure-plate (12) to a distal end associated with an end cap (22) configured for providing a non-slip association with floor (13).

Figure 2:
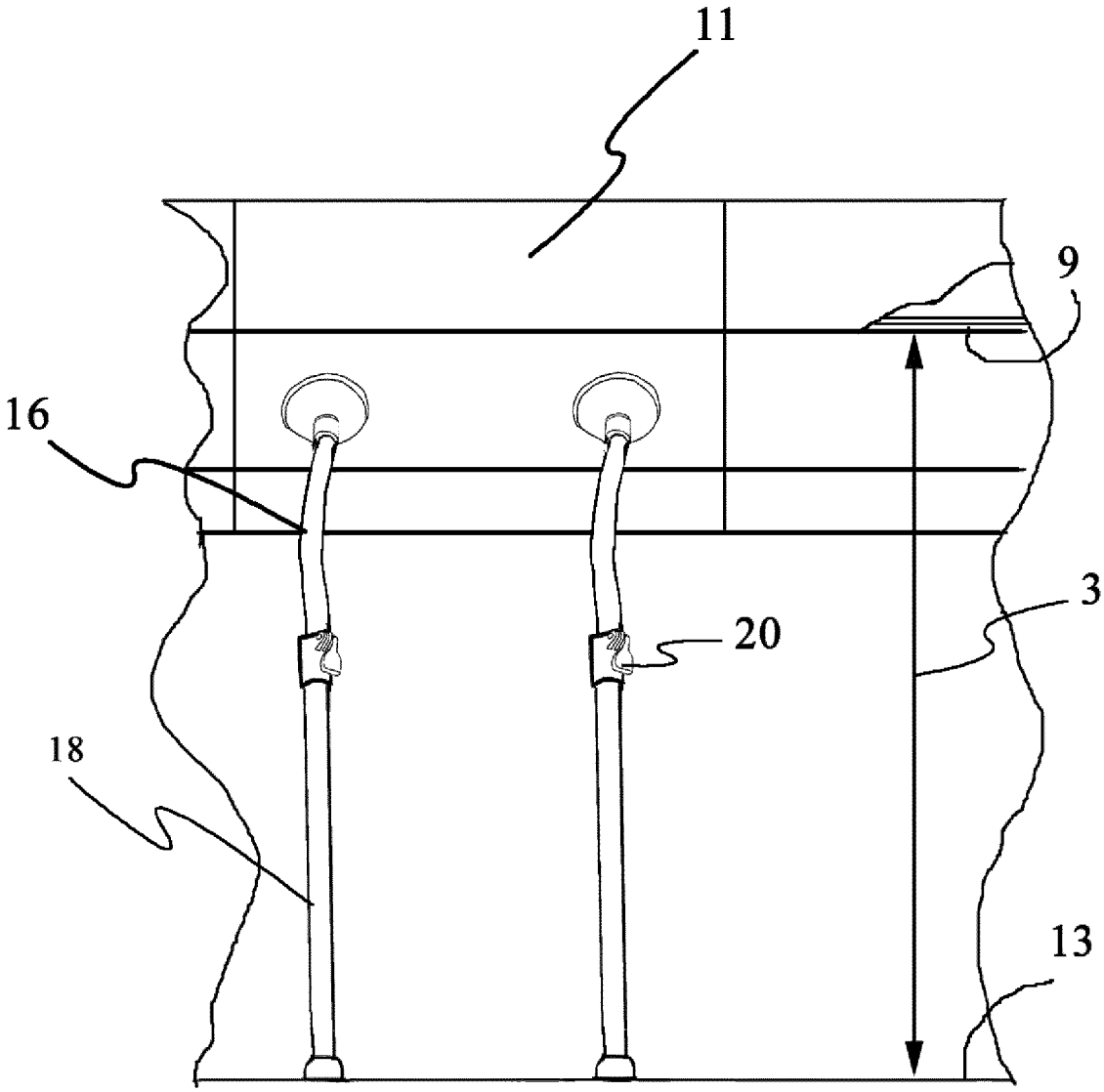
FIG. 2 is a side perspective view of two FIG. 1 apparatus being used to support a construction-item.
Figure 3:
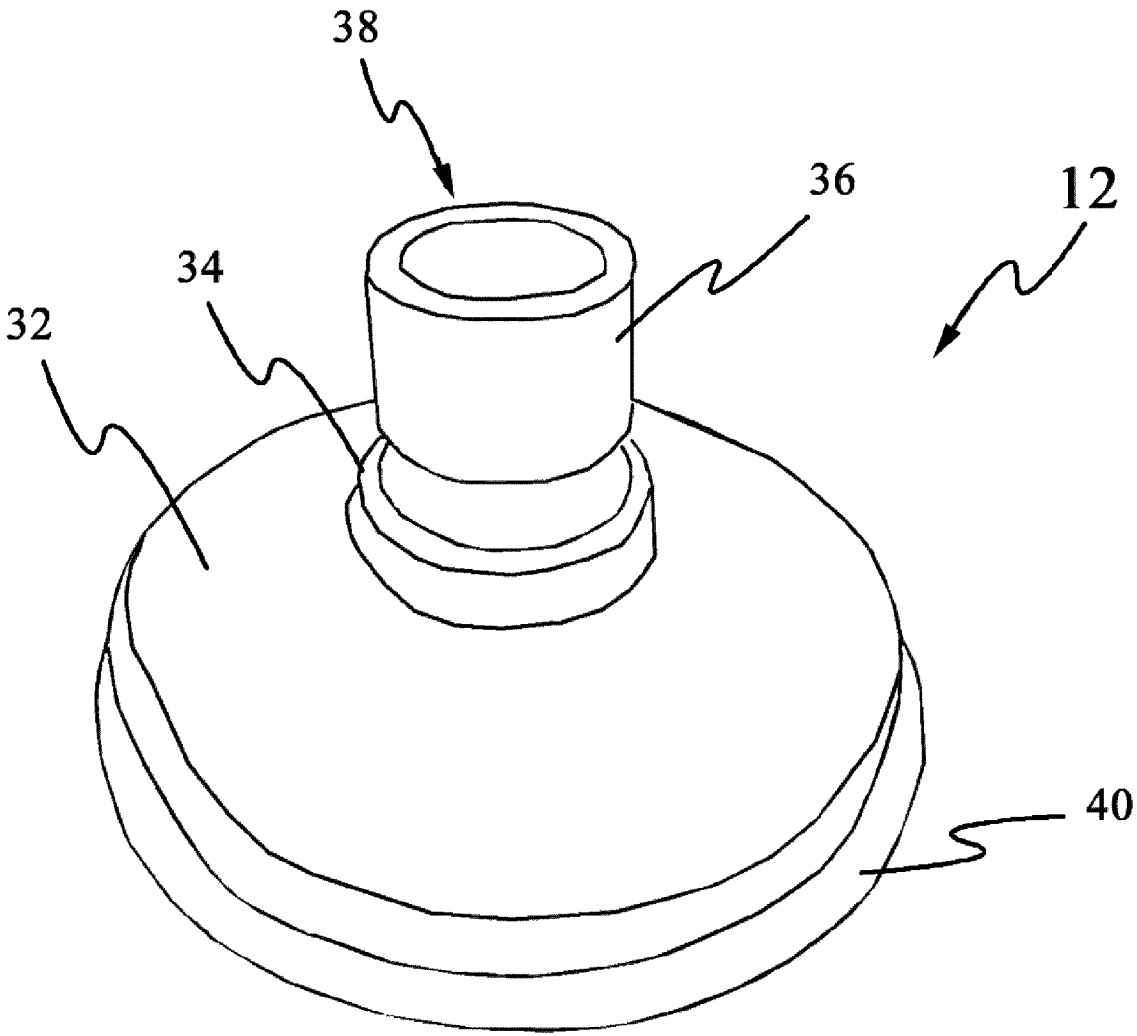
FIG. 3 is an elevated side perspective view of one embodiment of a pressure-plate.
Figure 4:
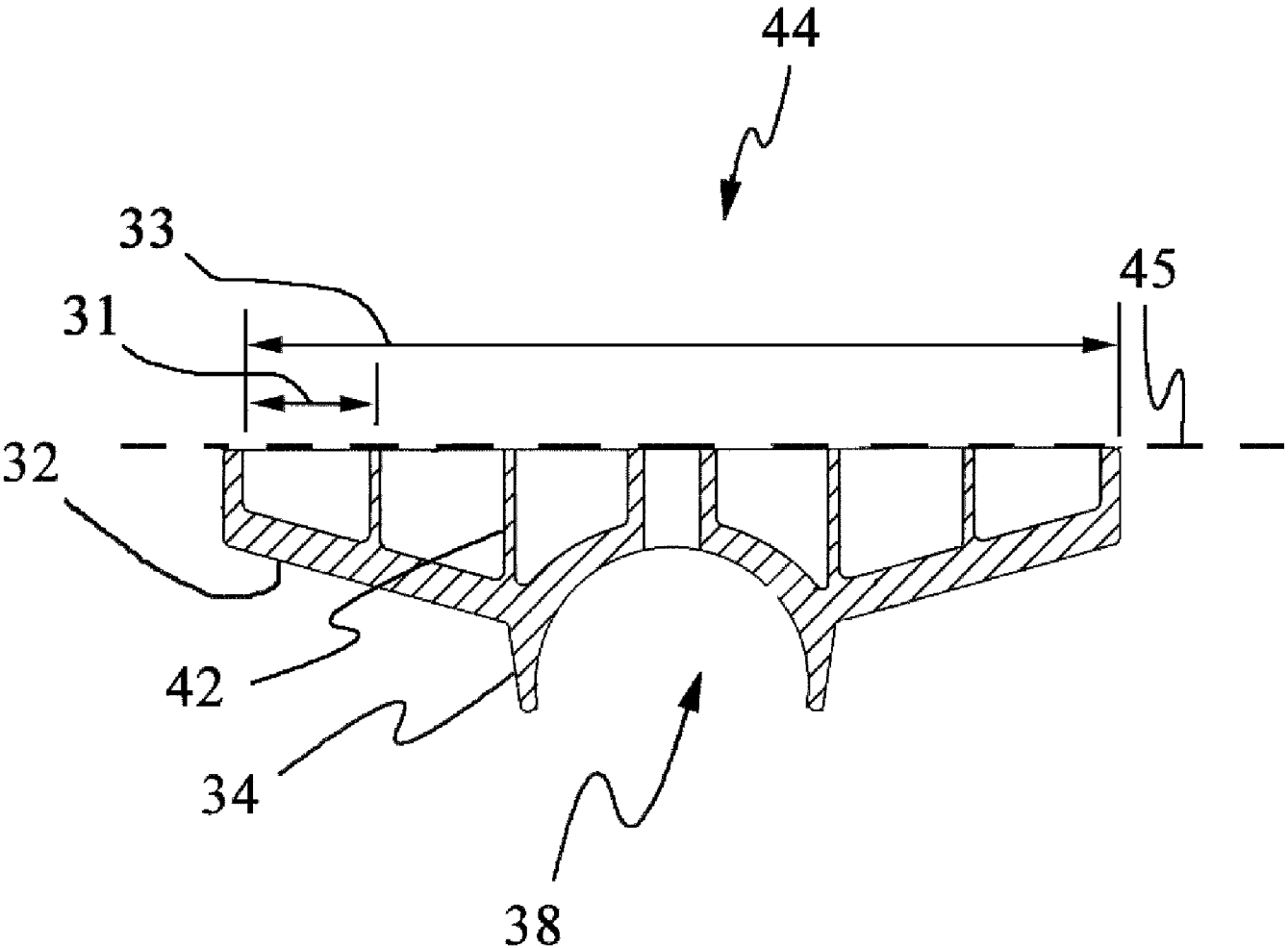
FIG. 4 is a side cut-away view of the pressure-plate shown in FIG. 3 comprising a pole-ball-socket receiver without a pole-ball-socket.

As best viewed in FIG. 4, for the presently preferred embodiment, the pressure-plate (12) comprises a pole-ball-socket receiver (34) defining opening (38). Referring back to FIG. 1*b*, opening (38) is suitably sized to receive a Pole-ball-socket (14) which is configured to receive one end of first pole section (16). Referring to FIG. 2, flexible pole section (16) is wedged between the construction item (11) and floor (13), via pressure-plate (12) in such a way to define a bow. One of ordinary skill in the art will appreciate that such a bow helps provide a support force to construction item (11) while also compensating for variations in the distance between first-construction-site-surface (9) and floor (13). The bow in pole section (16) defines angle (5). It should be appreciated that angle (5) may be any angle between zero and 90 degrees depending on the pressure plate (12), pole-ball-socket (14) design an pole section (16) design/configuration. For the configuration shown in FIG. 3 the maximum angle for angle (5) is around 60 degrees.

Referring now to FIG. 2, the first pole section (16) is movably associated with a second pole section (18) defining a telescoping arrangement via latching-device (20). Second Pole section (18) may or may not be flexible; although, for the preferred embodiment, both pole sections are flexible. A multiple pole section configuration is preferred as such a configuration allows apparatus (10) to be used to raise a construction-item from a lower level to a higher level by simply extending one or more pole sections as required. In addition, such an adjustment can compensate for large variations in distances between first-construction-site-surface (9) and floor (13) while the "flex" in pole section (16) and/or pole section (18) compensate for smaller variations. It should be appreciated, however, that apparatus (10) configurations comprising only one pole section fall within the scope of the invention.

The flexible pole sections are configured to be extendable (for multiple pole section configurations) to a predefined length. Typically, the predefined length is about four inches (4") longer than the distance from the first-construction-site-surface (9) and a second-construction-surface (13), such as floor 13. For the example depicted in FIG. 2, the distance from the first-construction-surface (9) and the second-construction-surface (13) is distance (3). When a plurality of pole sections and latching-device are used, the pole sections are adjusted to length just longer than distance (3) and then secured by the latching-device. The apparatus is then wedged between surface (9) and surface (13) creating a bow in the pole section(s).

When used to raise a construction item, pressure-plate-surface (7) is associated with one surface of a construction item and then the poles 16 and 18 are extended to the desired height and secured by latching-device (20). While extending the pole sections, apparatus (10) may be held at a angle relative to the second-construction-surface (13) so that the construction item may be raised to the desired height while allowing the pole sections to be extended a distance slightly greater than distance (3) (e.g. the previously described 4 inches). Next, a side pressure is applied to the pole section causing the pole section to flex and allowing end cap (22) to interface with second-construction-surface (13) thereby holding the construction item in place. It should be appreciated that the amount of (and location of) the "flex" depicted in the figures is for illustration purposes only and the actual flex in the pole section(s) may be quite different. For example, both sections may bow to form a uniform arc from surface (13) to surface (9).

Pressure Plate

Referring now to FIG. 3 and FIG. 4, FIG. 3 depicts an elevated side perspective view of one exemplary embodiment for pressure-plate (12) while FIG. 4 depicts a side cut away view of pressure-plate (12). Pressure-plate (12) defines a top section defining a pole-ball-socket-receiver (34) disposed in the approximate center of said top section and further defining a substantially flat pressure-surface opposed to said pole-ball-socket-receive (34). Pole-ball-socket-receiver (34) is suitably sized and configured for being associated with pole-ball socket (36). For the presently preferred embodiment, top section comprises a parabolic section (32) further defining a plurality of pressure-transfer-rails (42) wherein each pressure-transfer-rail is parallel to an adjacent pressure-transfer-rail. Additionally, each pressure-transfer-rail extends away from such parabolic section a predefined distance, defined by line (45), thereby defining said substantially flat plain referred to as pressure-surface (44). Pressure surface (44) may be configured to receive a protective-padding (40) to minimize risk of damaged to a construction-item.

Figure 5:
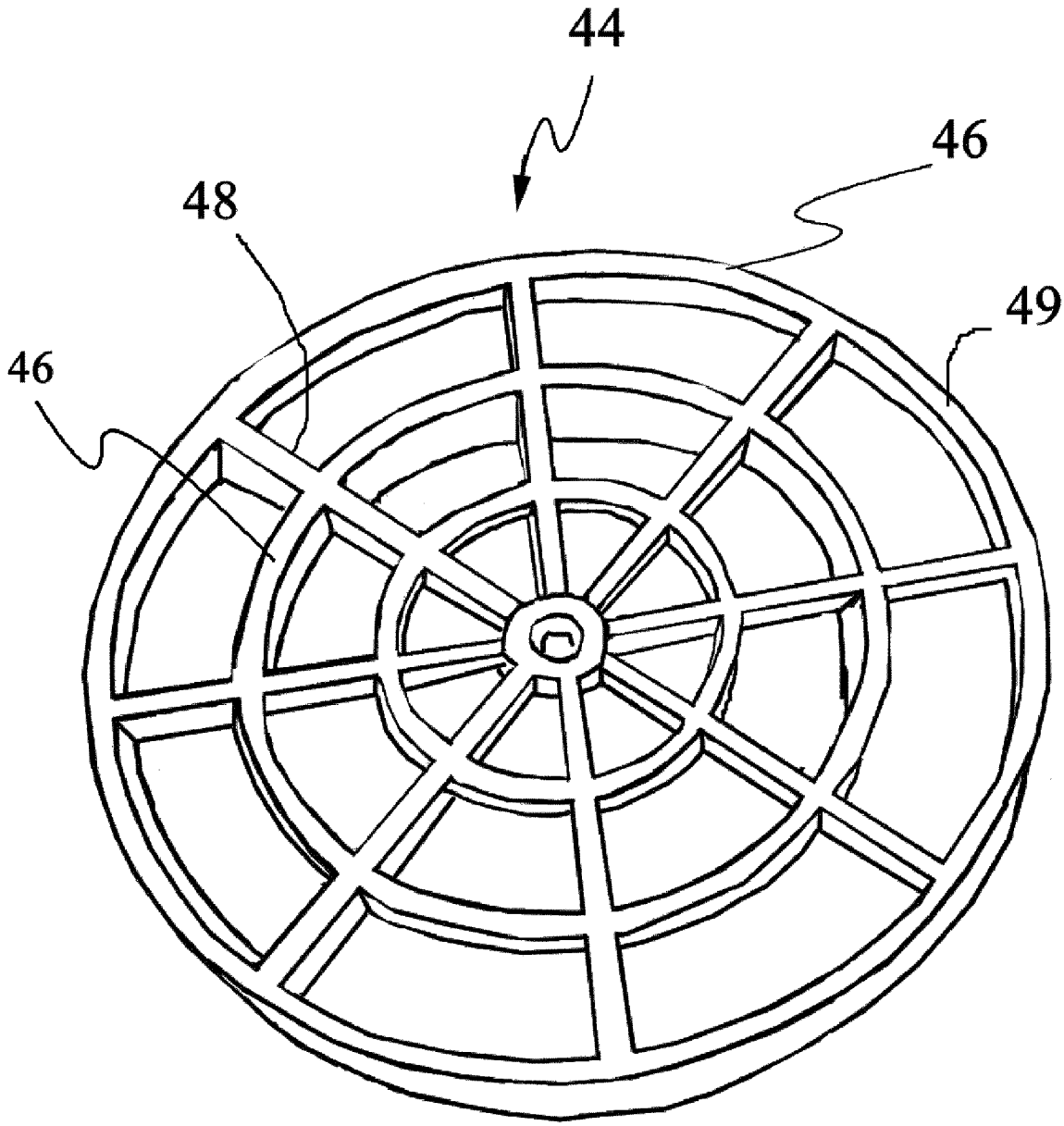
FIG. 5 is an elevated side perspective view of a pressure surface for the apparatus shown in FIG. 3 with the pressure-padding removed.

As shown in FIG. 4 and FIG. 5, as noted above, pressure surface (44) is defined by a plurality of pressure-transfer-rails (42). For the presently preferred embodiment, pressure-transfer-rails (42) define a plurality of concentric circles (46) starting at the approximate center of parabolic section (32) with outer-most pressure-transfer-rail defining the perimeter of the pressure plate thereby defining to the approximate width of said substantially flat pressure surface (i.e. the outer diameter of the parabolic section).

Each such pressure-transfer-rail (42) extends from the parabolic section (32) to rail-surface (49) so as to define a substantially flat plain which defines substantially flat pressure-surface (44). Restated, while each pressure-transfer-rail may have different "heights" (the distance from the parabolic section to a predefined point), the rail-surface (49) for each pressure-transfer-rail (42) define a substantially flat support surface with all such support surfaces defining a substantially flat plain along line (45). Pressure-plate (12) may be constructed to have any sized desired to address a particular tasks, however, for the preferred embodiment, each inter-rail space (31) (FIG. 4) (the distance between adjacent pressure-transfer-rails) is about ⅙ the width (33) of pressure-surface (44).

Figure 6:
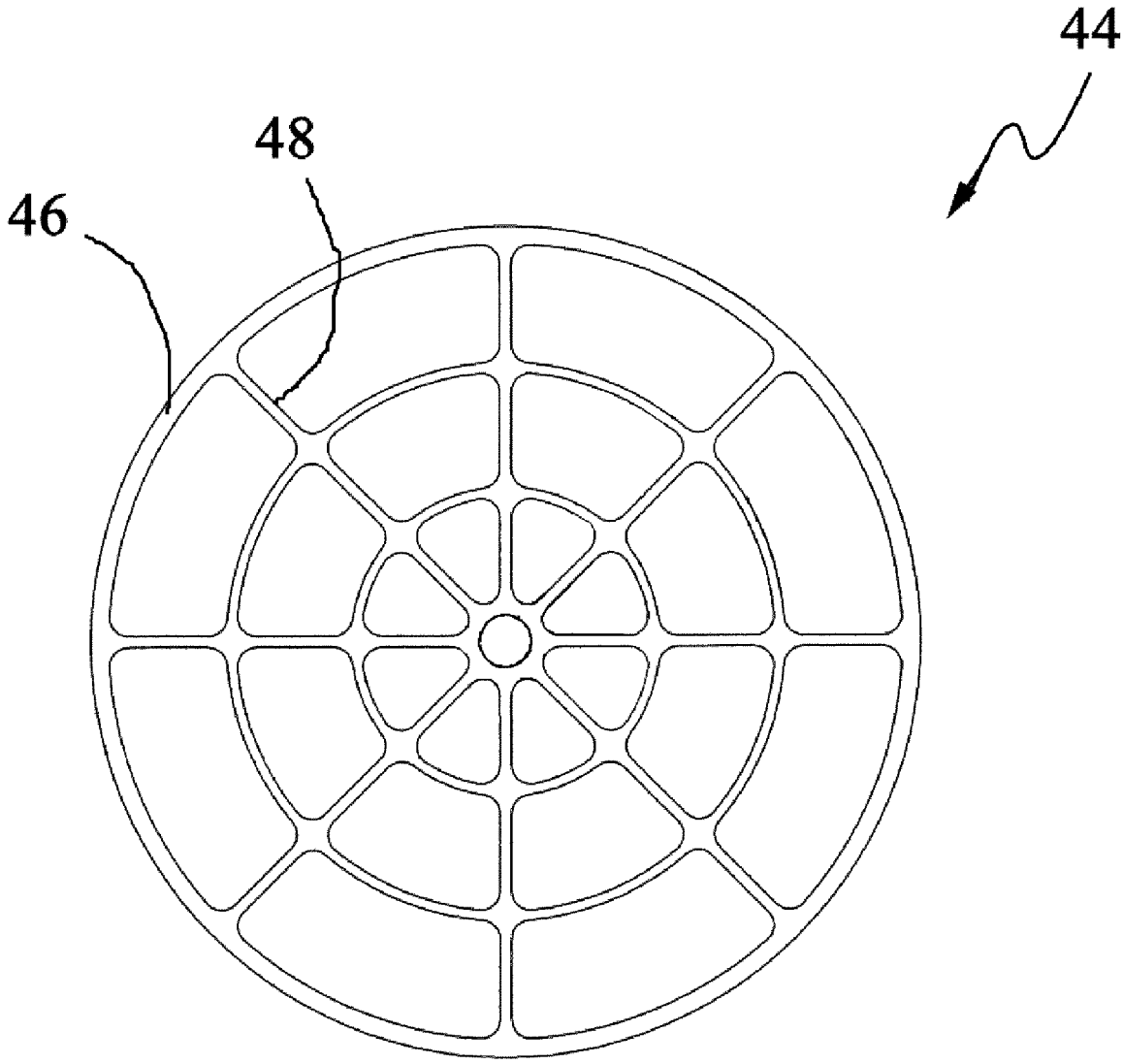
FIG. 6 is a top view of the pressure surface shown in FIG. 5.

As best viewed in FIG. 5 and FIG. 6, for the presently preferred embodiment of the invention, pressure-transfer-rails (42) define concentric circles (46) and spokes (48). Spokes (48) provide added structural support between adjacent rails.

Using rails and spokes in such a configuration lowers the weight and cost of pressure-plate (12) by providing hollow sections between the concentric circles (46) and spokes (48).

Figure 7:
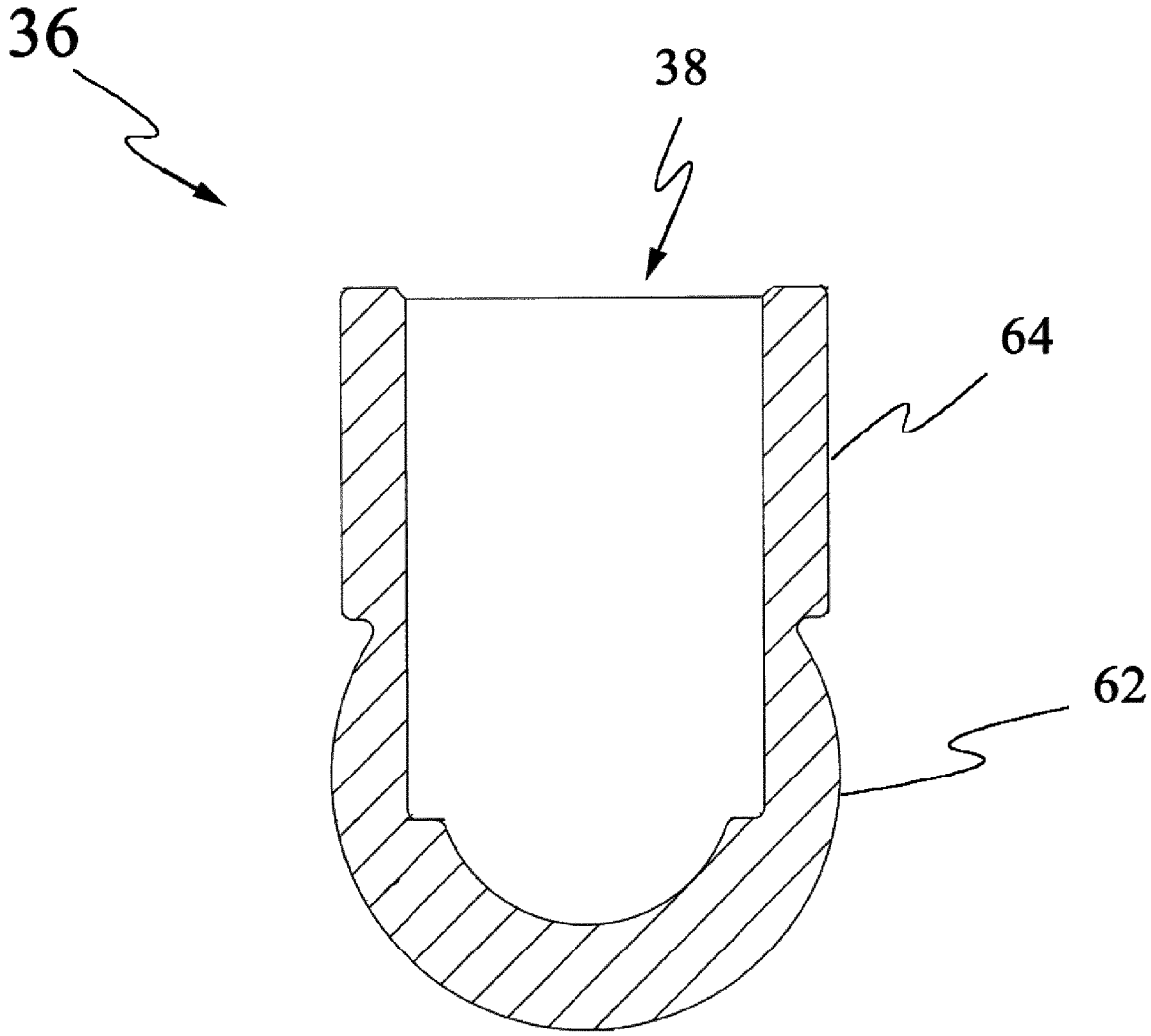
FIG. 7 is a side cut away view of one exemplary embodiment of a the pole-ball-socket.

Referring now to FIG. 7, a side cut away view of one exemplary pole-ball-socket (36) configuration is presented. Pole-ball-socket (36) defines an opening (38) configured to receive one end of a pole section such as pole section (16). Pole-ball-socket (36) further defines a ball-section (62) suitably sized for being snapped into pole-ball-socket-receiver (34) in a secured movable association. A "secured movable association" is an association between two components that snap together (for example) to form a movable association that does not become "unsnapped" under normal use but can be "unsnapped" by apply sufficient opposing forces on such components. One of ordinary skill in the art will appreciate that the combination of movable ball socket and flexible poles provides a superior flex/pivot action that a system with only one of such features could not provide.

Figure 8:
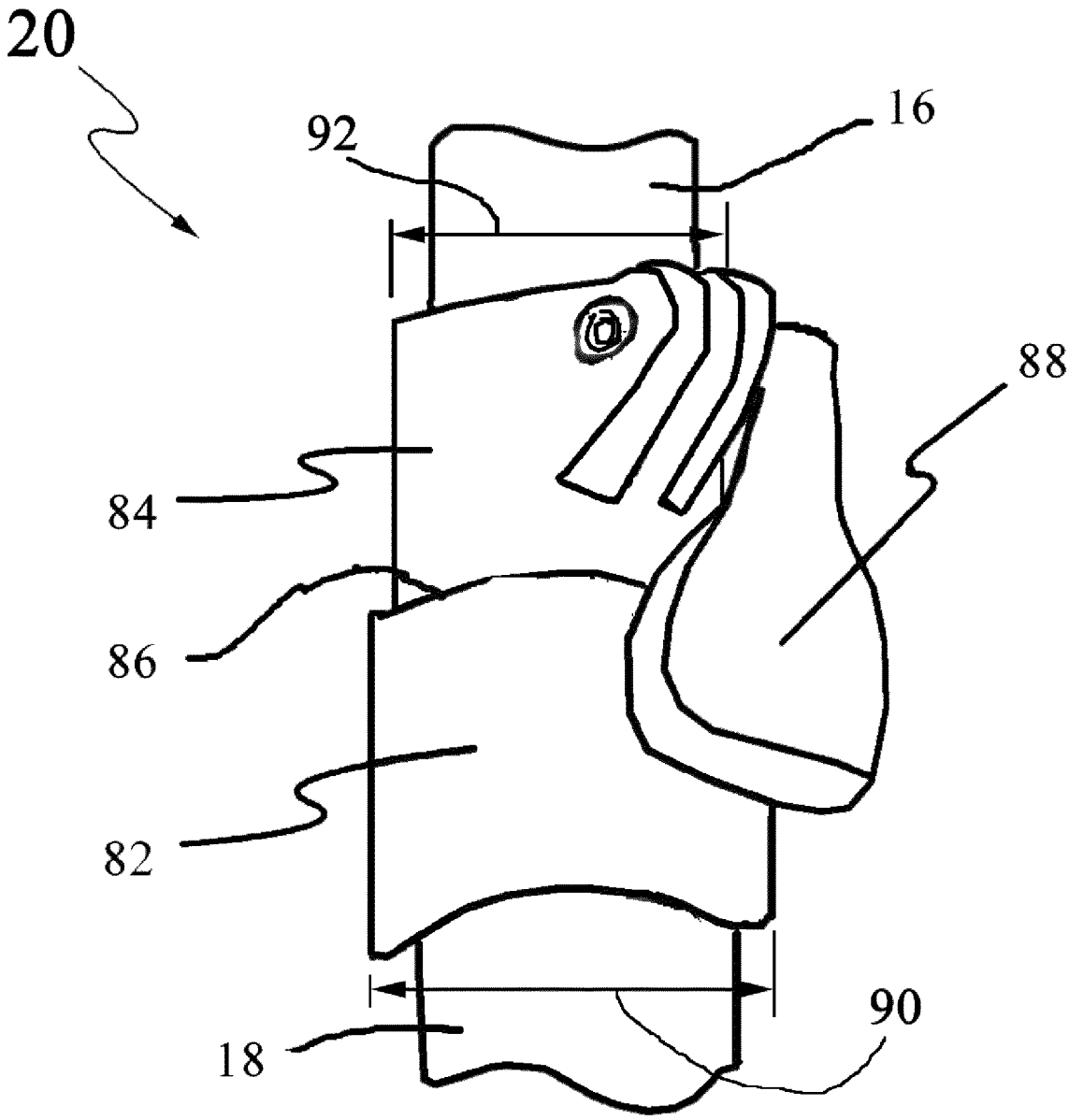
FIG. 8 is a side perspective view of one exemplary embodiment of a latching-device.

Referring now to FIG. 8, a side perspective view of one exemplary latching-device (20) configuration is presented. Latching-device (20) comprises a first-pole-receiver (82) defining a generally round socket having a diameter (90) that is slightly larger than the diameter of pole-section (18). Similarly, latching-device (20) comprises a second-pole-receiver (84) defining a generally round socket having a diameter (92) that is slightly larger than the diameter of pole-section (16). First-pole-receiver (82) further defines a pole stop (not shown) along its med-section (86) that prevents pole-section (18) from extending through hollow latching-device (20). However, second-pole-receiver (84) does not have a pole stop thereby allowing pole section (16) to extend through latching-device (20) and into pole-section (18) to form a telescoping arrangement.

When latching-lever (88) is pressing against first-pole section (82), second-pole-receiver (84) squeezes together to clamp down on pole-section (16) thereby locking pole-section (16) into a desired position. When latching-lever (88) is moved away from first-pole-receiver (82), second-pole-receiver (84) expends outward for the previously squeezed position thereby allowing pole-section (16) to move.

It should be noted that there are typically one (1) less latching-device than there are pole sections. For example, for a two pole section configuration, there will be one latching device and for a three pole section configuration there will be two latching devices. Each latching device will have the same characteristics but be slightly different diameters for associating with poles of slightly different diameters. When there is only one pole section, such pole section is manufactured to the desired predefined length.

While the present subject matter has been described in detail with respect to specific embodiments thereof, it will be appreciated that those skilled in the art, upon attaining an understanding of the foregoing may readily adapt the present technology for alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A method of supporting a construction item comprising a first surface and an opposing second surface, said first surface being associated with an elevated surface a predefined distance above a lower surface, said method comprising the steps of:

providing a pressure plate comprising a first side defining a pole-ball-socket-receiver disposed in the approximate center of said pressure plate and a second side defining a substantially flat pressure surface wherein said pressure surface is associated with said second surface of said construction item;

associating the ball section of a pole-ball-socket with said pole-ball-socket-receiver forming a secure movable association;

associating a flexible pole structure with the pole-receiver section of said pole-ball-socket;

wherein said flexible pole structure is one of (a) a flexible pole having a length longer than the distance between said elevated surface and said lower surface; and (b) a first flexible pole movably associated with a second pole in a telescopic configuration extended to an overall length that is longer than the distance between said elevated surface and said lower surface; and wedging the flexible pole structure between said elevated surface and said lower surface thereby forming a bow in the flexible pole structure thereby causing said pressure surface to generate a supporting force against said second surface of said construction item.

2. A method of supporting a construction item comprising a first surface and an opposing second surface as in claim 1, wherein said second pole is flexible.

3. A method of supporting a construction item comprising a first surface and an opposing second surface as in claim 1, wherein the pole-ball-socket pivots in the direction of the bow.

4. A method of supporting a construction item comprising a first surface and an opposing second surface as in claim 1, further comprising the step of associating a latching-device with said first flexible pole and said second flexible pole, said latching-device configured to receive said first flex pole and said second flex pole, wherein said first flex pole has a slightly smaller diameter than the diameter of said second flex pole and where the first flex pole is configured to extend through the latching-device and into said second flex pole thereby defining a telescoping association.

5. A method of supporting a construction item comprising a first surface and an opposing second surface as in claim 1, wherein said substantially flat pressure surface is defined by a plurality of pressure-transfer-rails defining a plurality of concentric circles.

6. A method of supporting a construction item comprising a first surface and an opposing second surface as in claim 5, wherein said movable association between said pressure plate and said pole-ball-socket is configured to allow for the angle between said hollow tube and said substantially flat pressure-surface to be varied from perpendicular to about 45 degrees.

* * * * *